US006094884A

United States Patent [19]

Christensen et al.

[11] Patent Number: 6,094,884

[45] **Date of Patent: *Aug. 1, 2000**

[54] FORMING APPARATUS FOR AN ELEVATED BOTTOM CARTON

[75] Inventors: Charles Christensen, Centuria, Wis.; Mats Johansson, Veberod, Sweden

[73] Assignee: Tetra Laval Holdings & Finance, SA, Pully, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 09/128,183

[22] Filed: Aug. 3, 1998

Related U.S. Application Data

[63] Continuation-in-part of application No. 08/955,063, Oct. 21, 1997, Pat. No. 5,845,840, which is a continuation-in-part of application No. 09/052,401, Mar. 31, 1998, Pat. No. 5,988,490.

[51] Int. Cl.[7] ..... B65B 7/00; B31B 1/28

[52] U.S. Cl. ..... 53/375.9; 493/133; 493/164; 493/183

[58] Field of Search ..... 53/375.9, 375.8, 53/376.2; 493/133, 164, 183, 141, 156, 58

[56] References Cited

U.S. PATENT DOCUMENTS

| | | | |
|---|---|---|---|
| 2,523,251 | 9/1950 | Pantalone et al. . | |
| 2,815,164 | 12/1957 | Painter . | |
| 3,275,216 | 9/1966 | Collins . | |
| 3,402,876 | 9/1968 | Kuchenbecker . | |
| 3,412,922 | 11/1968 | Miller et al. . | |
| 3,971,300 | 7/1976 | Bachner | 53/375.9 |
| 4,221,162 | 9/1980 | Kauffman et al. . | |
| 4,313,556 | 2/1982 | Boyle et al. . | |
| 4,332,577 | 6/1982 | Mosse . | |
| 4,589,862 | 5/1986 | Murrah . | |
| 4,601,425 | 7/1986 | Bachner . | |
| 4,776,830 | 10/1988 | Fujikawa et al. . | |
| 4,838,847 | 6/1989 | Kume et al. . | |
| 4,861,328 | 8/1989 | Franke et al. | 493/183 |
| 4,986,058 | 1/1991 | Carlsson et al. . | |
| 4,990,128 | 2/1991 | Murrah . | |
| 5,056,707 | 10/1991 | Larsen . | |
| 5,120,292 | 6/1992 | Ueda et al. . | |
| 5,152,736 | 10/1992 | Owen et al. . | |
| 5,167,607 | 12/1992 | Larsen . | |
| 5,222,667 | 6/1993 | Fujikawa et al. . | |
| 5,232,146 | 8/1993 | Antonacci . | |
| 5,234,398 | 8/1993 | Larsen . | |
| 5,295,941 | 3/1994 | Fujikawa et al. . | |
| 5,762,595 | 6/1998 | Santiago et al. | 493/133 |

FOREIGN PATENT DOCUMENTS

| | | |
|---|---|---|
| 0112553 | 12/1982 | European Pat. Off. . |

*Primary Examiner*—John Sipos
*Assistant Examiner*—Steven Jensen
*Attorney, Agent, or Firm*—Welsh & Katz, Ltd.

[57] ABSTRACT

A bottom forming apparatus having a mandrel cap and a sealing plate configured to create a carton with an elevated bottom. The present invention alleviates the problem of cartons having soggy bottoms since the point of absorption, the raw paperboard edge, is elevated above the moisture which may be present during distribution from the packaging machine to the retailer. The elevated bottom portion is actually inverted into the carton with planar portions resting on the surface to support the carton. The sealing plate has a multitude of elevated portions and the mandrel cap has a recess and an angled edge for elevating the raw paperboard edge. The various embodiments of the sealing plate are able to elevate most carton bottom configurations including the standard TETRA REX® carton and the TETRA REX® sixth panel with skived edge carton.

20 Claims, 13 Drawing Sheets

FORMING APPARATUS FOR AN ELEVATED BOTTOM CARTON

CROSS REFERENCES TO RELATED APPLICATIONS

This is a continuation-in-part application of U.S. patent application Ser. No. 08/955,063 filed on Oct. 21, 1997, now U.S. Pat. No. 5,845,840, and U.S. patent application Ser. No. 09/052,401 filed on Mar. 31, 1998, now U.S. Pat. No. 5,988,490, which are both hereby incorporated by reference.

STATEMENT REGARDING FEDERALLY SPONSORED RESEARCH OR DEVELOPMENT

Not Applicable

BACKGROUND OF THE INVENTION

1. Field of the Invention

The present invention relates to bottom forming apparatuses for cartons. Specifically, the present invention relates to a bottom forming apparatus for a carton having portions of the bottom elevated to protect the raw paperboard edges from damage and absorption of moisture.

2. Description of the Related Art

Cartons fabricated from a carton blank on a form, fill and seal packaging machine risk absorption of moisture into the raw paperboard edges of the bottom of the carton. This absorption is accelerated if the raw paperboard edges are damaged and the carton is continuously exposed to moisture. The transportation, loading and storage of the carton from the conveyance between the packaging machine/packer unit and the retailer display are all sources for damage and moisture absorption.

The raw paper edges are a by-product of the composition of the carton blank. Generally, the carton blank is cut and scored from a sheet of coated fiberboard material. The coated fiberboard material is usually composed of three layers, and may have a barrier layer juxtaposed between fiberboard layers. The exposed surfaces of this sheet are coated with a polymer material such as polyethylene. However, the coating does not extend to the edges which are thus left uncoated, and partially unprotected at least to moisture and sensitive to damage. When the carton is erected and partially formed, these raw paper edges are most prevalent at the bottom of the carton. If moisture is absorbed into the raw paper edges, the water may be absorbed throughout the fiberboard interior layer, which due to its cellulose-like nature, has a strong affinity for liquids. This absorption of moisture may compromise the integrity of the carton thereby rendering it defective.

This problem has yet to be directly addressed by the packaging industry. However, inventions directed to resolving the stability of cartons have been disclosed in the prior art. Mills et al., U.S. Pat. Nos. 5,482,204, and 5,588,943, respectively for a Carton Bottom Sealer and Carton Bottom Sealing Dies disclose cartons having an embossed inverse pyramidal bottom which is directed to providing greater stability to the filled carton and to reduce bulging of the carton. It should be noted, as shown in FIGS. 8 and 9 of the Mills et al. Patents, that the end portions of the exposed raw paper edges of the bottom of the carton are not embossed, and therefore are susceptible to moisture absorption.

Fujikawa et al., U.S. Pat. No. 5,222,667, for a Container Made Of Paper-Base Laminate, similarly discloses a carton having an inverted V-shaped bottom to provide greater stability to the carton. As shown in FIG. 6 of the Fujikawa et al. Patent, the raw paper edge of panel 27 is not inverted and is susceptible to moisture absorption since the V-shaped inversion begins at the raw paper edge and since the inversion must be centered to provide stability to the carton.

BRIEF SUMMARY OF THE INVENTION

The present invention resolves the problem of absorption of moisture through raw paperboard edges by providing a carton having the raw paper edges elevated in order to protect the raw paperboard edges and reduce the susceptibility of moisture absorption. The present invention is able to accomplish this without adversely affecting the carton.

One aspect of the present invention is a bottom forming apparatus having a sealing plate and a mandrel cap formed to elevate the raw paperboard edges of the carton. The mandrel cap has a recess with an angled edge corresponding to the placement of the raw paperboard edge of the bottom of a carton. The angled edge may have the angle downward to form a beveled edge. The sealing plate has a first elevated portion partitioned into two sections, a traversal section and an edge section which mate with the recess area and angled edge of the mandrel cap to form the elevated portions. The sealing plate may also have a second elevated portion thereon.

Various embodiments of the sealing plate are set forth for elevating the bottom of cartons having different bottom configurations.

Another aspect of the present invention is a method for forming a carton having an elevated bottom.

It is a primary object of the present invention to provide a method and apparatus for forming a carton having elevated raw paperboard edges on the bottom to prevent moisture absorption.

It is a further object of the present invention to provide a bottom forming apparatus having a sealing plate with elevated portions and a mandrel cap with a recess area and an angled edge.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which.

DETAILED DESCRIPTION OF THE INVENTION

Figure 1:
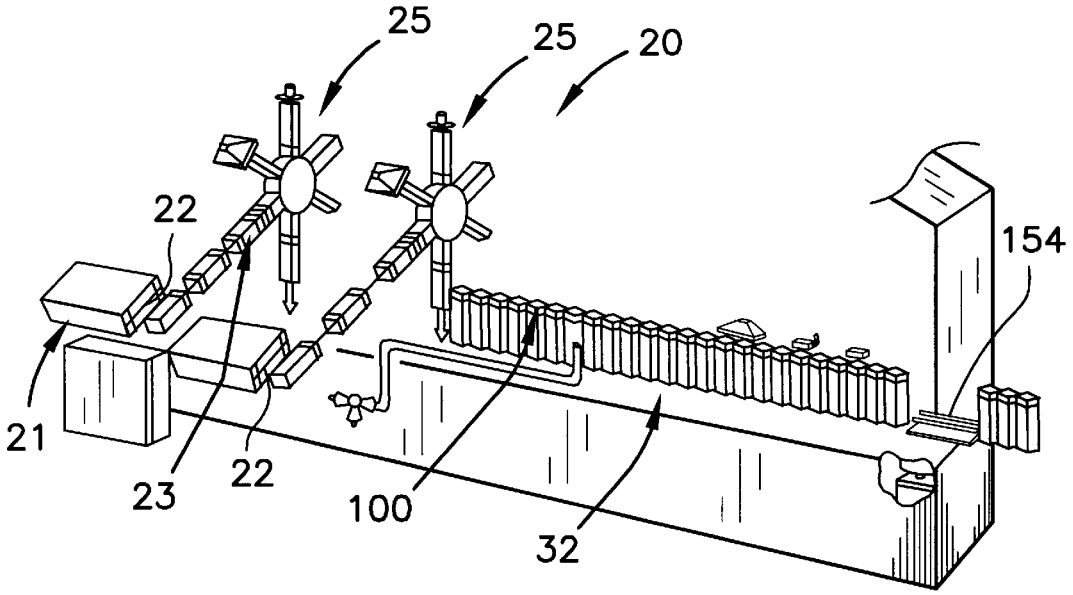
FIG. 1 is a schematic view of a packaging machine for producing cartons having an elevated bottom.
Figure 2:
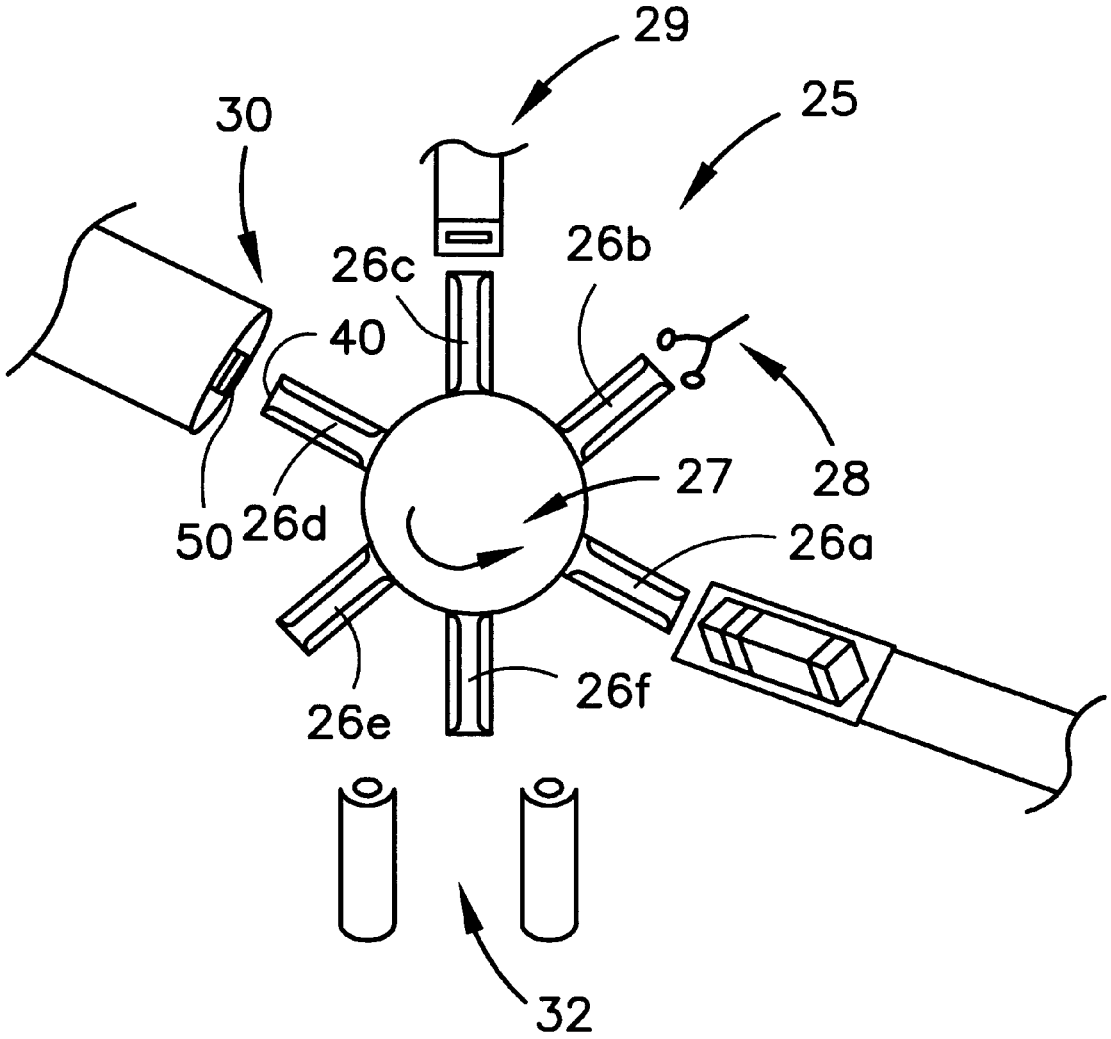
FIG. 2 is an isolated schematic view of a bottom forming assembly of the present invention.

As shown in FIGS. 1 and 2, a packaging machine for forming, filling and sealing cartons is generally designated 20. One example of such a machine is a TETRA REX® packaging machine available Tetra Pak, Inc. of Chicago, Ill. A plurality of carton blanks 22 are fed from a magazine 21 to a bottom forming section 25 of the machine 20. During the transfer from the magazine 21 to the bottom forming station 25, each of the carton blanks 22 is erected to a partially-formed state wherein the top and bottom of the carton is open. On the bottom forming station 25, as best shown in FIG. 2, the bottom of the carton is formed at a number stations. First, an erected carton blank 23 is placed upon a mandrel 26. The mandrels 26*a–f* rotate about a turret 27. Although six mandrels are shown, other configurations have five or four mandrels rotating about a turret 27. The bottom panels of each carton are pre-folded at a pre-folding station 28, and then heated at a heating station 29. The bottom panels are then heat sealed together at a sealing station 30. The sealing of the bottom panels is accomplished by pressing a sealing unit 50 against the bottom panels as they lie on a mandrel 26, and specifically a mandrel cap 40. The carton 100, with its bottom sealed, is then ejected from the mandrel 26 onto a conveyor 32 for further processing on the packaging machine 20. The elevated bottom is formed at the sealing station 30 by an unique sealing plate 50 and an unique mandrel cap 40.

Figure 3:
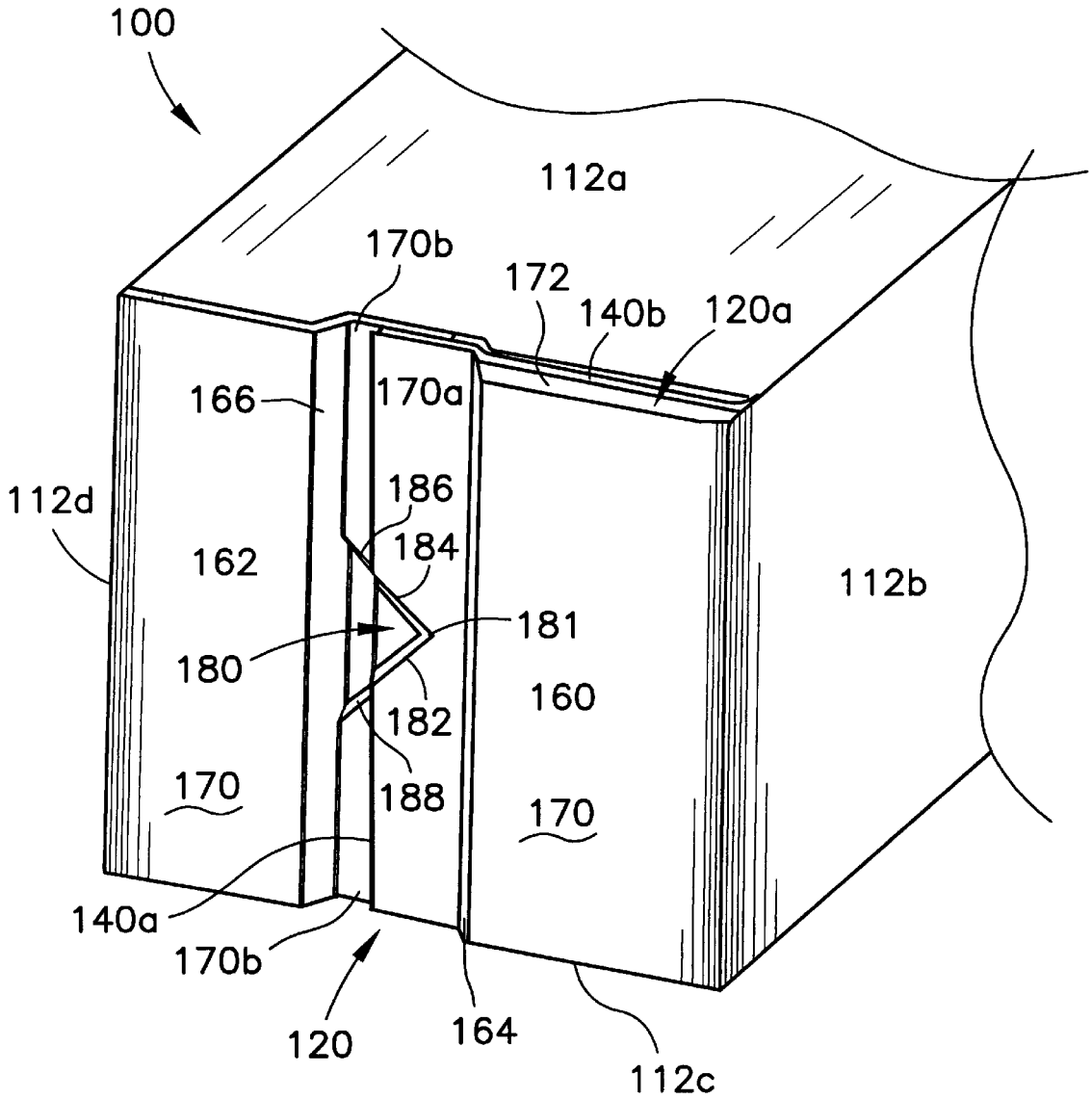
FIG. 3 is a bottom perspective view of one embodiment of a carton fabricated from bottom forming assembly of the present invention.

As shown in FIG. 3, the bottom of the carton 100 has an elevated portion 120 bounded by substantially planar portions 160 and 162. The planar portions 160 and 162 are substantially perpendicular to side panels 112*a*, 112*b* and 112*c* and 112*d*, not shown. The planar portions 160 and 162 contact the conveyor belt 154 while elevated portion 120 is elevated above the belt 154 and any moisture thereon. The same applies during distribution whether in a crate or a shelf at a store.

The elevated portion 120 is further defined by angled portions 164 and 166 and elevated planar portion 170. The elevated planar portion 170 is further defined as elevated planar portion 170*a* and elevated planar portion 170*b*. The elevated planar portion 170*a* substantially includes a portion of panel 132*b* while elevated planar portion 170*b* includes a portion of panel 132*d*. The exposed raw paper edge 140*a* extends across the bottom of the carton 100, from the end of panel 112*a* to the end of panel 112*c*, not shown. Likewise, the elevated portion 120 extends across the bottom of the carton 100. The elevated portion 120 may be centered on the bottom of the carton 100 with planar portions 160 and 162 being equal in area to each other. However, those skilled in the pertinent art will recognize that planar portions 160 and 162 may be unequal and elevated portion 120 may be uncentered without departing from the scope and spirit of the present invention.

Elevated portion 170*a*, angled portion 164 and planar portion 160 may all be part of bottom panel 132*b*. Also, elevated portion 170*b*, angled portion 166 and planar portion 162 may all be part of bottom panel 132*d*.

The exposed edge 140*b* is substantially perpendicular to exposed edge 140*a*. A side elevated portion 120*a* elevates this exposed edge 140*b* thereby preventing moisture absorption as with exposed edge 140*a*. The side elevated portion 120*a* has an angled portion 172 which engages planar portion 160, side panel 112*a*, and angled portion 164. Those skilled in the art will recognize that any exposed raw paperboard edges may be elevated in a similar fashion without departing from the scope and content of the present invention.

Approximately in the center of the elevated portion 120 is a secondary elevated portion 180. The secondary elevated portion 180 prevents loss of elevation in the center of the bottom of the carton 100 during transportation from a packaging machine to the retailer/wholesaler to the consumer. As is apparent, the center of the bottom of the carton 100 is most susceptible to deelevation from the weight of the product. The weight of the product in the carton 100 is focused on the center of the bottom of the carton 100, and thus it is necessary to provide greater elevation in this area. This greater elevation is provided by the secondary elevated portion 180 which compensates for gravitational forces exerted by the product on the center of the bottom of the carton 100.

In a preferred embodiment, the secondary elevated portion 180 is triangular in shape with its apex 181 near the exact center of the bottom of the carton 100. The secondary elevated portion 180 is substantially contained within elevated planar portions 170*a* and 170*b*. However, there is a transition to angled portion 166. Alternatively, the triangular shaped embodiment of the secondary elevated portion 180 may be rotated any degree from 1–360 degrees, about apex 181 while not departing from the scope and spirit of the present invention. Thus, the secondary elevated portion 180 may lie entirely within elevated planar portion 170*a*.

In the preferred embodiment, the secondary elevated portion 180 is partially defined by secondary angled portions 182, 184, 186 and 188. The secondary angled portions 182 and 184 form a transition from the secondary elevated portion 180 to elevated planar portion 170*a* whereas the secondary angled portions 186 and 188 form a transition from the secondary elevated portion 180 to elevated planar portion 170*b*.

Figure 5:
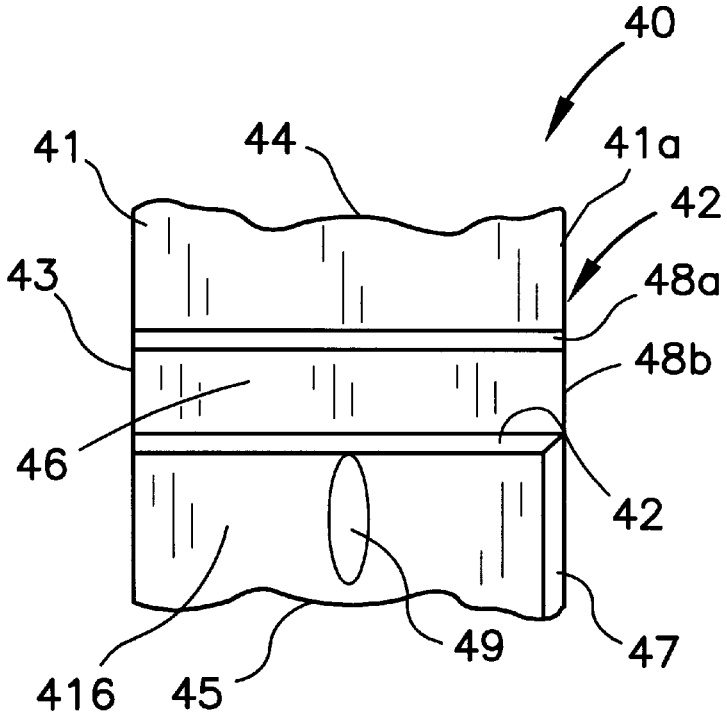
FIG. 5 is a top plan view of the mandrel cap of FIG. 4.
Figure 4:
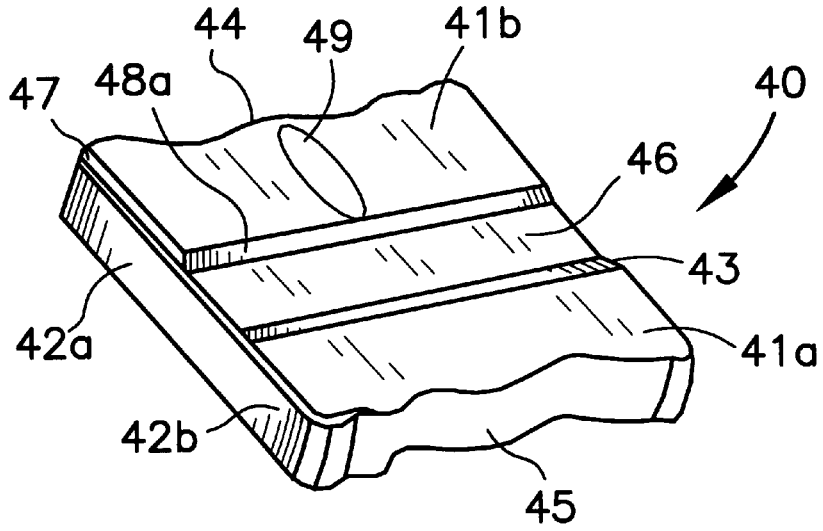
FIG. 4 is an isolated top perspective view of a mandrel cap of the present invention.

A mandrel cap 40 of the present invention is shown in FIGS. 4 and 5. The mandrel cap 40 has an engagement surface 41*a–b* that engages with the bottom panels for mating with the sealing plate 50 to form the elevated bottom carton 100. Generally, the mandrel cap 40 has a first end 42, a second end opposite the first end, and third and fourth ends 44 and 45 as shown. The third and fourth ends 44 and 45 may be non-straight as shown or straight. The first end may be partitioned into a first portion 42*a* and a second portion 42*b*. The engagement surface 41 is traversed by a recess 46 that extends from the first end 42 to the second end 43. The width of the recess 46 is generally less than the combined area of engagement surfaces 41*a–b*, however those skilled in the pertinent art will recognize that the width may be equal or larger than such combined area.

The engagement surface 41 also has an angled edge 47 along the first portion 42*a* of the first end 42. The angled edge 47 connects with the recess 46 at the transition edge 48*b*. Another transition edge 48*a* lies opposite the first transition edge 48*b*. The mandrel cap 40 may also have an elliptical groove 49.

Figure 6:
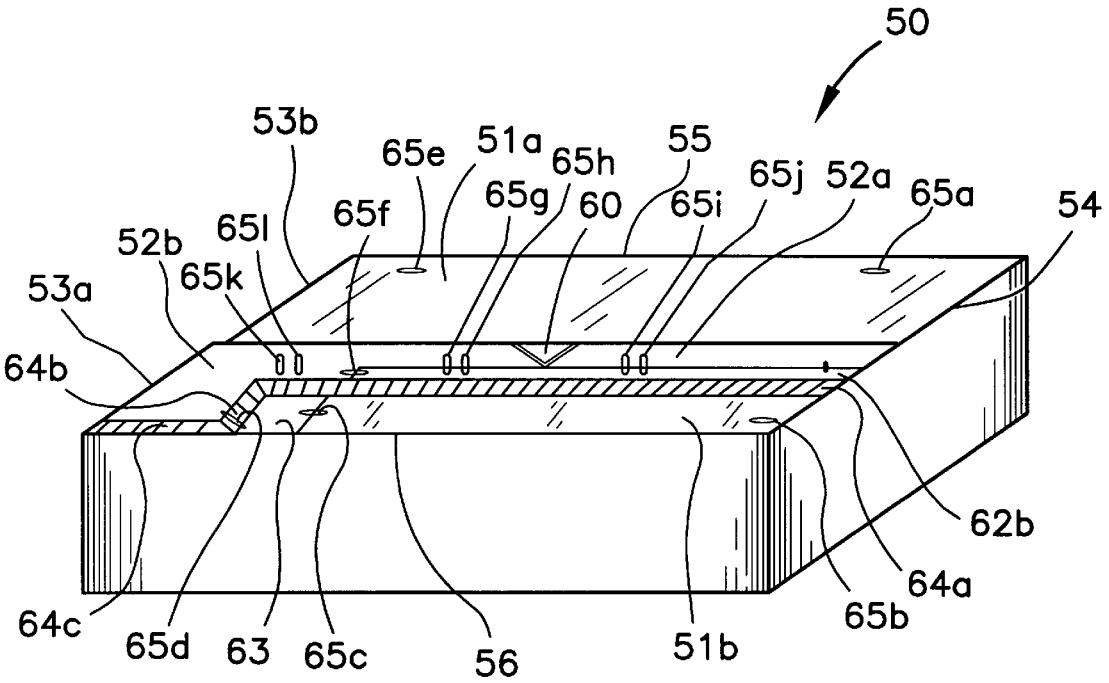
FIG. 6 is an isolated top perspective view of a preferred embodiment of a sealing plate of the present invention.
Figure 7:
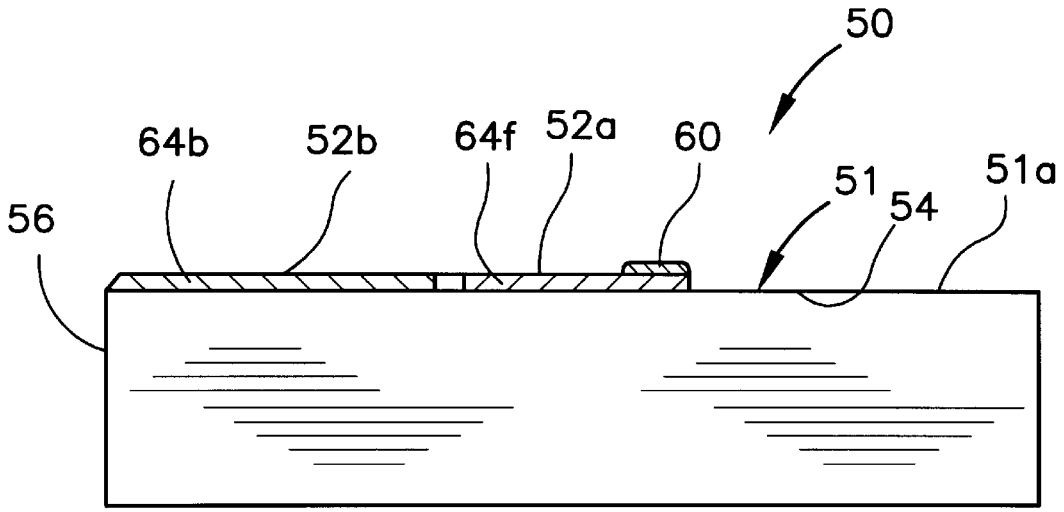
FIG. 7 is a side plan view of the sealing plate of FIG. 6.
Figure 8:
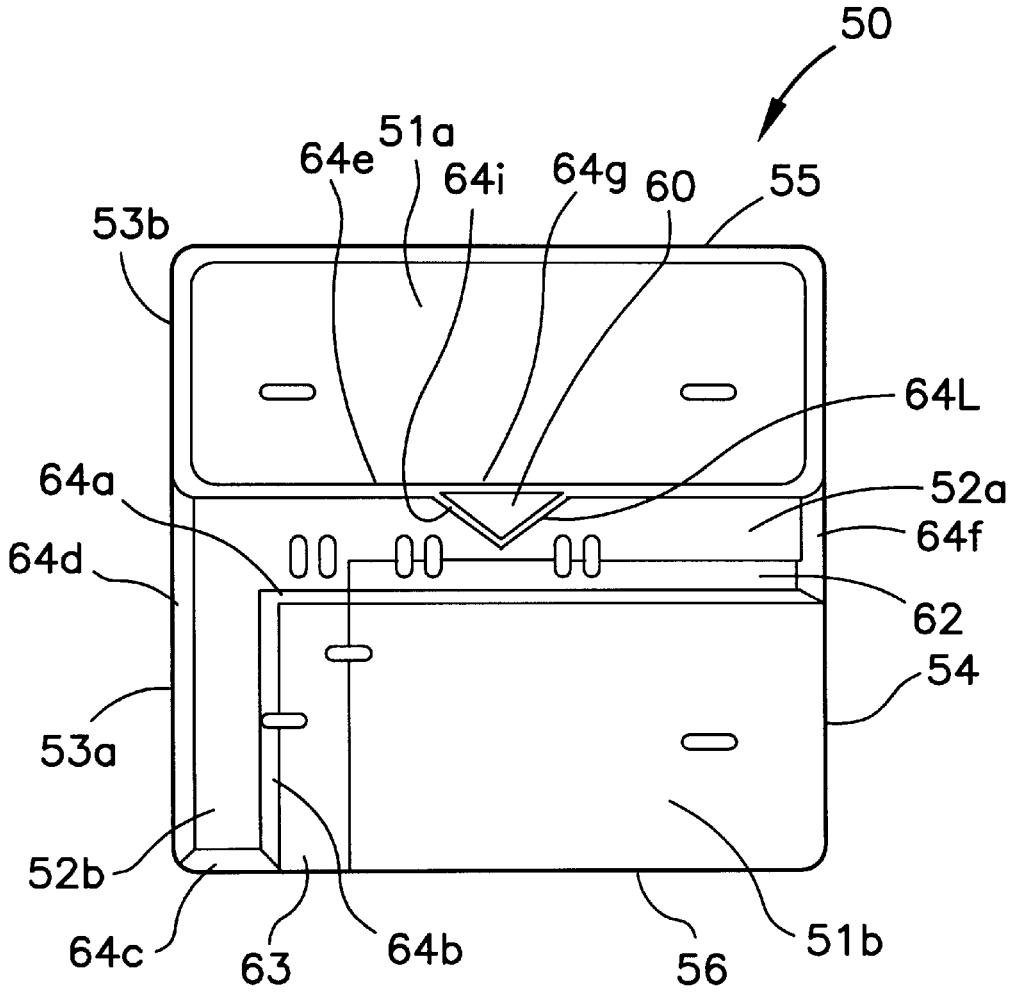
FIG. 8 is a top plan view of the sealing plate of FIG. 6.

FIGS. 6–8 illustrate a preferred embodiment of the sealing plate 50 of the present invention. The sealing plate has a pressing surface 51 that lies on a first horizontal plane, and which engages with the bottom panels of a carton 100 and the mandrel cap 40. The generally flat pressing surface 51 is interrupted by a first elevated portion 52 which may be partitioned into a traversal section 52*a* and an edge section 52*b*. The traversal section 52*a* traverses the pressing surface 51 from a first end 53 of the sealing plate 50 to a second end 54 of the sealing plate 50. The sealing plate 50 will also have a third end 55 and a fourth end 56. The plan-section of the sealing plate 50 may be square, rectangular, circular, triangular or the like. The edge section 52*b* is generally perpendicular to the traversal section 52*a*, and edge section 52*a* extends along a portion 53*a* of the first end 53 of the sealing plate 50.

The first elevated portion 52, including both sections 52*a* and 52*b*, is generally flat and lies on a second horizontal plane above that of the first horizontal plane defined by the pressing surface 51. However, the edge section 52*b* may lie on a different horizontal plane than the traversal section 52*a*, and both sections 52*a–b* may be non-flat surfaces. The first elevated portion 52 is interrupted by a second elevated portion 60 that generally lies in the traversal section 52*a*. Although shown as triangular, the second elevated portion 60 may be of any shape or configuration. The second elevated portion 60 is generally flat and lies on a third horizontal plane above the second horizontal plane.

A second pressing layer 62 may be disposed on the sealing plate 50. The second pressing layer 62 may cover a portion of the traversal section 52*a* of the first elevated portion 52. In general, the second pressing layer 62 will lie above the second horizontal plane but below the third horizontal plane. A pressing surface recess layer 63 is generally flat and lies below the first horizontal plane. The recess area 63 is defined by the pressing surface 51*b*, the edge section 52*b*, the traversal section 52*a* and the fourth end 56 of the seal plate 50.

In general, the height variations on the sealing plate 50 are connected by a plurality of transition edges 64*a–i*, the most important of which are transition edges 64*a* and 64*b* which assist in the elevation of the elevated portions 120 and 120*a* on the elevated bottom carton 100, as shown in FIG. 3. The transition edges 64*a–i* are preferably beveled for a gradual transition from one plane the next. However, those skilled in the art will recognize that some or all of the transition edges may not be beveled and may have a steeper transition between planes or a non-flat edge. A plurality of channel block protrusions 65*a–l* may be disposed about the sealing plate 50, on the pressing surface 51, the first elevation 52, the second pressing layer 62 and at the transition edges 64*a–i*. The channel block protrusions 65*a–l* act to create a further moisture barrier in the carton 100 should the raw paperboard edges 140*a* and 140*b* begin to wick.

Figure 9:
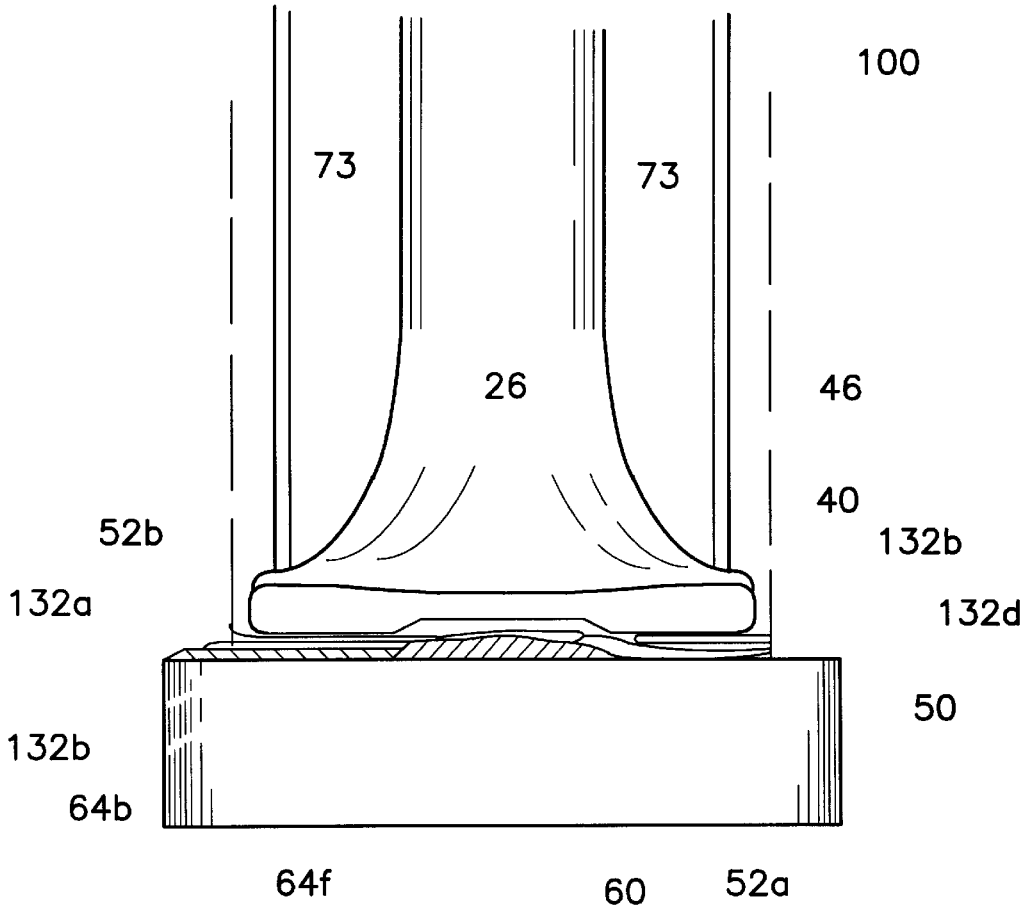
FIG. 9 is a side plan view of a sealing plate and mandrel cap of the present invention engaging a carton to form an elevated bottom.

FIG. 9 shows a carton 100 having its bottom formed by simultaneous engagement between the sealing plate 50 and the mandrel cap 40. The mandrel cap 40 is attached or integrated therewith a mandrel 26. The mandrel 26 may also have a plurality of support 73 engaging with the mandrel cap 40. The bottom panels 132*a–d* of the carton 100 are sealed together and embossed to form the elevated portions 120 and 120*a*. The bottom forming may occur at the bottom forming station 30 disposed about the mandrels 26 rotating on the turret 27. Alternatively, the carton 100 may be placed onto an isolated mandrel cap 40 and sealing plate 50 for bottom forming before conveyance to further stations on the packaging machine 20.

Figure 10:
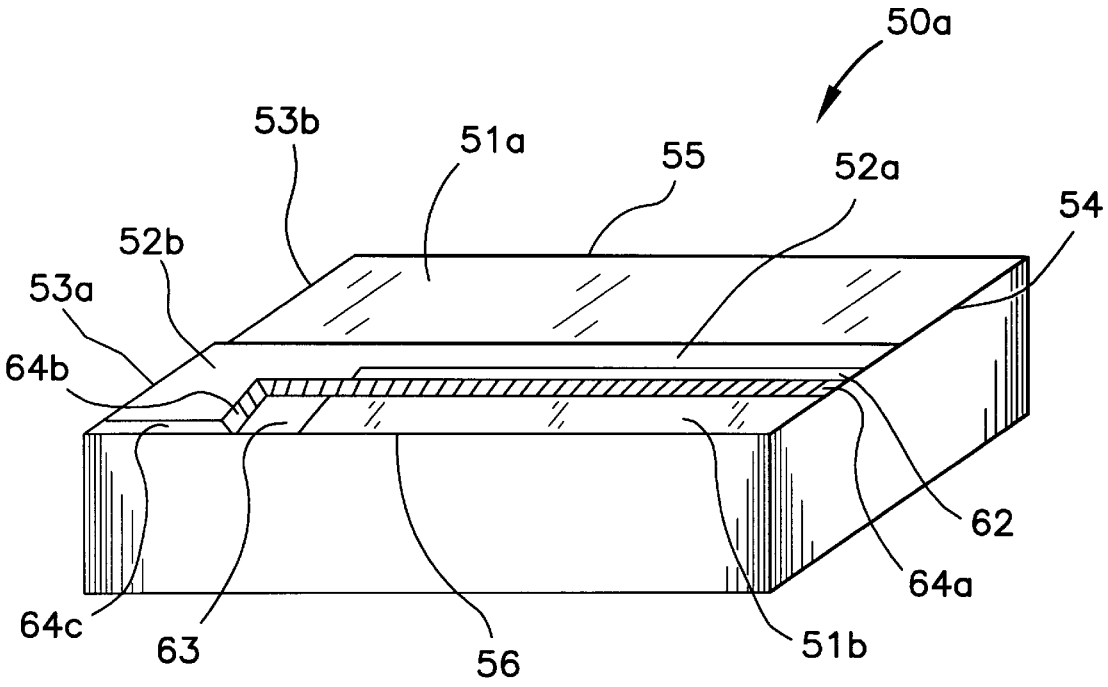
FIG. 10 is a top perspective view of an alternative embodiment of a sealing plate of the present invention.
Figure 11:
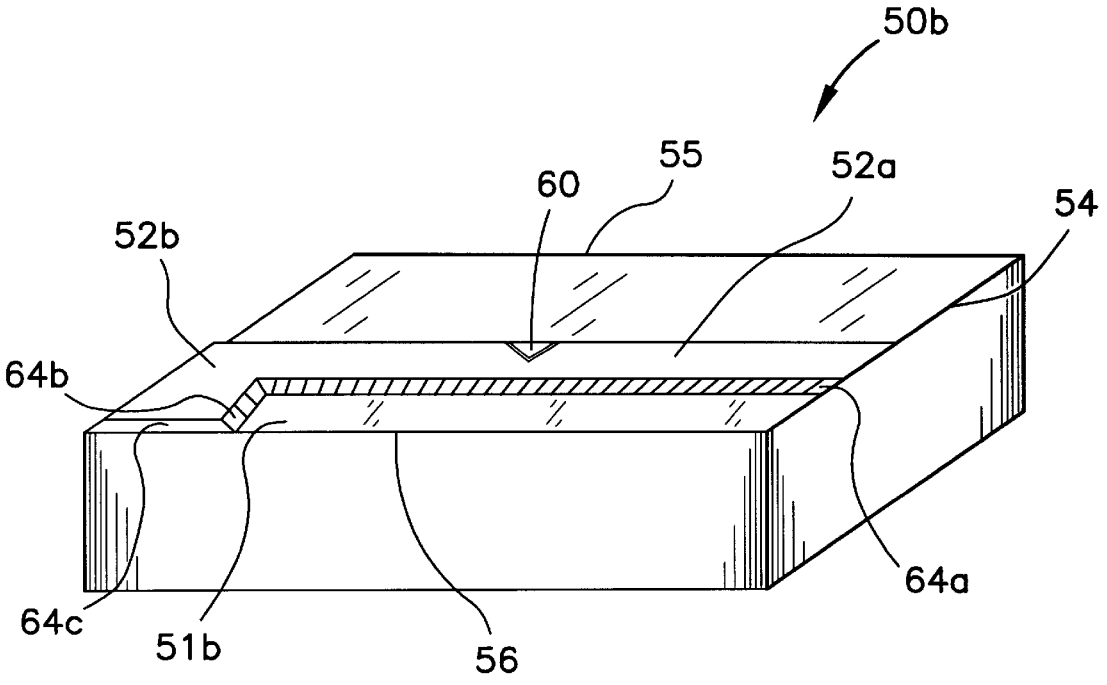
FIG. 11 is a top perspective view of an alternative embodiment of a sealing plate of the present invention.

FIGS. 10 and 11 are alternative embodiments of the sealing plate. The sealing plates 50*a–b* of FIGS. 10 and 11 are slight variations on the sealing plate 50 of FIG. 6. The sealing plates 50*a–b* are without many of the various elevations of the sealing plate 50 of FIG. 6, most noticeably the second elevated portion 60 on sealing plate 50*a*.

Figure 12:
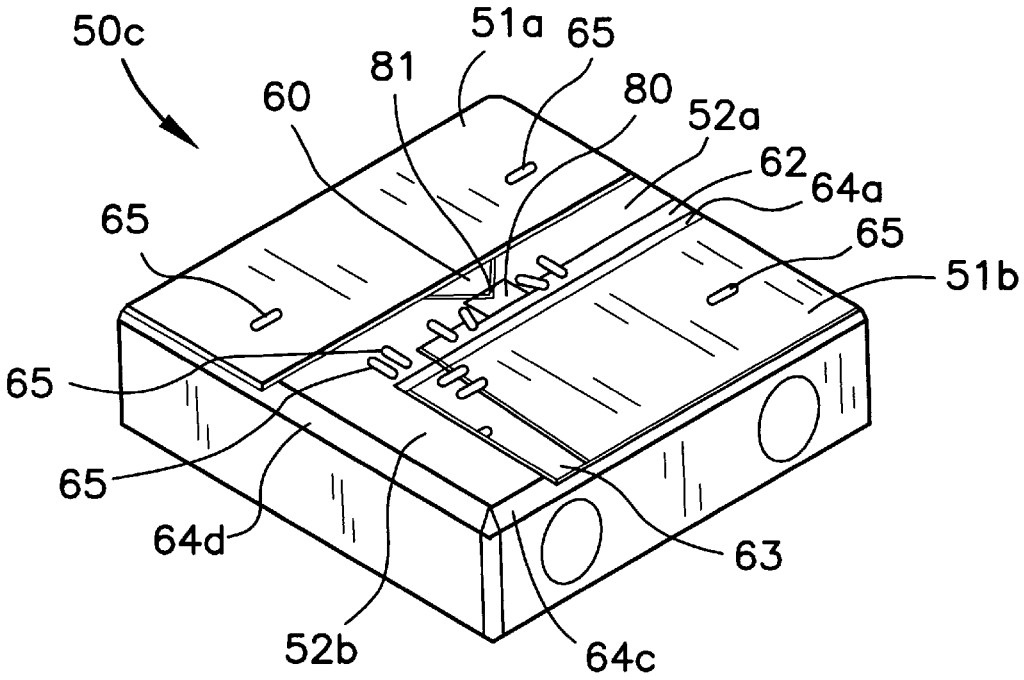
FIG. 12 is a top perspective view of an alternative embodiment of a sealing plate of the present invention.
Figure 13:
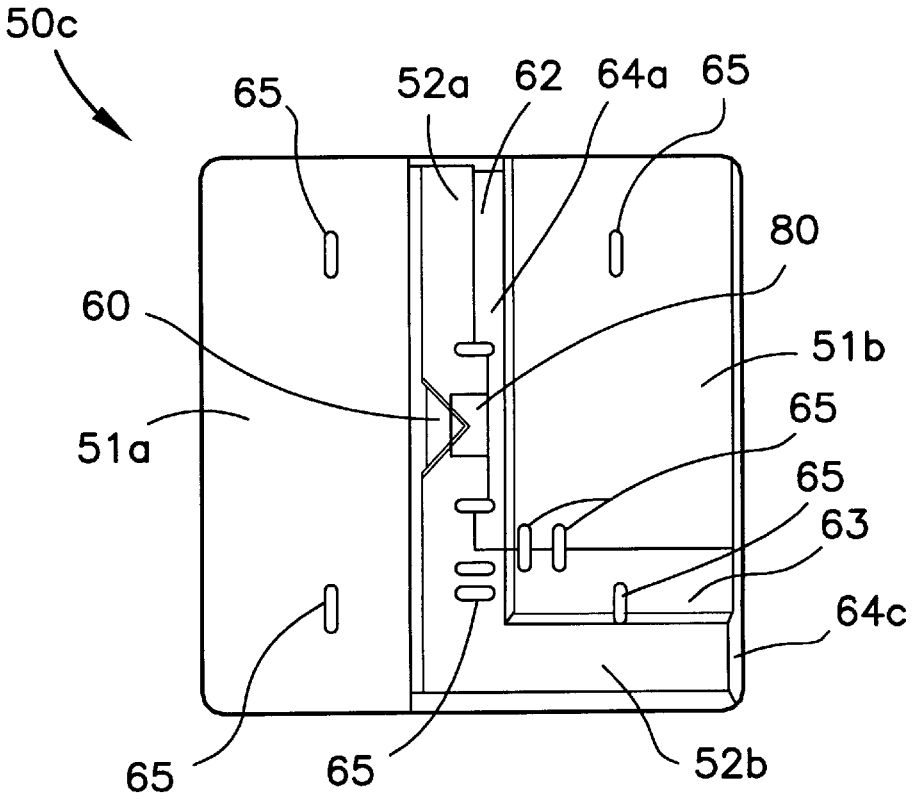
FIG. 13 is a top plan view of the sealing plate of FIG. 12.

FIGS. 12 and 13 represent different views of an alternative embodiment of the sealing plate of the present invention. Similarities between the sealing plate 50 of FIG. 6 and the sealing plate 50*c* of FIGS. 12 and 13 will utilize the same reference designations. The sealing plate 50*c* has a sixth panel recess 80 disposed on the first elevated portion 52*a* and a portion of the second elevated portion 60. Although the recess 80 lies below the second horizontal plane of the first elevated portion 52, the recess 80 may have a surface above the first horizontal plane of the pressing surface 51. The intersection 81 of the recess 80 and the second elevated portion 60 may have a surface that lies on the second horizontal plane of the first elevated portion 52. The sealing plate 50*c* is primarily directed at providing an elevated bottom on a TETRA REX® sixth panel skived edge carton.

Figure 14:
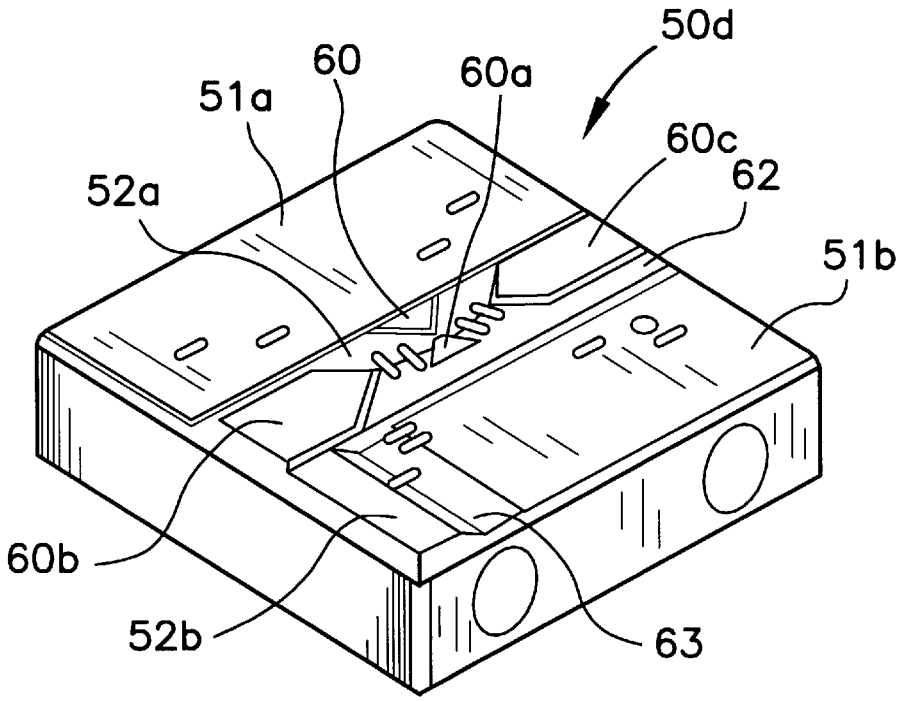
FIG. 14 is a top perspective view of an alternative embodiment of a sealing plate of the present invention.
Figure 15:
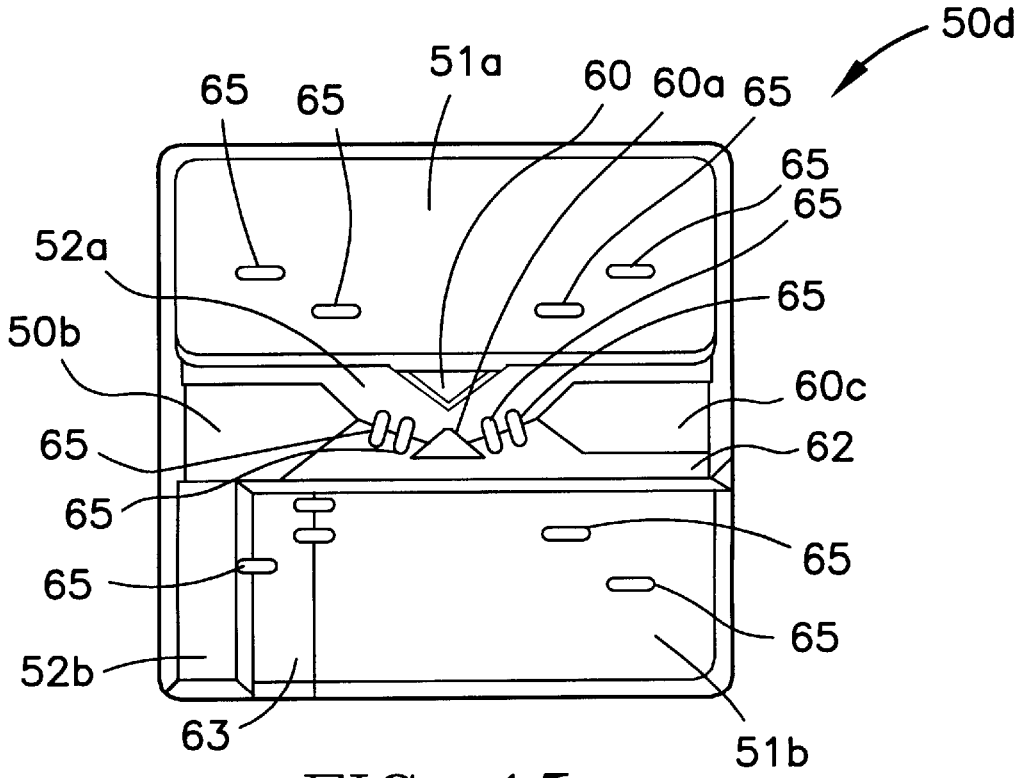
FIG. 15 is a top plan view of the sealing plate of FIG. 14.

FIGS. 14 and 15 represent different views of an alternative embodiment of the sealing plate of the present invention. Similarities between the sealing plate 50 of FIG. 6 and the sealing plate 50*d* of FIGS. 14 and 15 will utilize the same reference designations. The sealing plate 50*d* is primarily directed at providing an elevated bottom on a carton formed from a low resource carton blank such as the one described in co-pending U.S. patent application No. 08/766,493, filed on Dec. 13, 1996, entitled Stackable Gable Top Carton And Corresponding Top Interlocking Carton Blank which relevant parts are hereby incorporated by reference. The sealing plate 50*d* has the pressing surface 51*a–b* and first elevated portions 52*a–b*, although the edge portion 51*b* is not adjacent the traversal portion 52*a*. The sealing plate 50*d* also has a plurality of second elevated portions 60, 60*a*, 60*b* and 60*c* which may all lie on the third horizontal plane. A plurality of channel protrusions 65 are also dispersed throughout the sealing plate 50*d*. The various elevations also have transition edges between different elevations.

Figure 16:
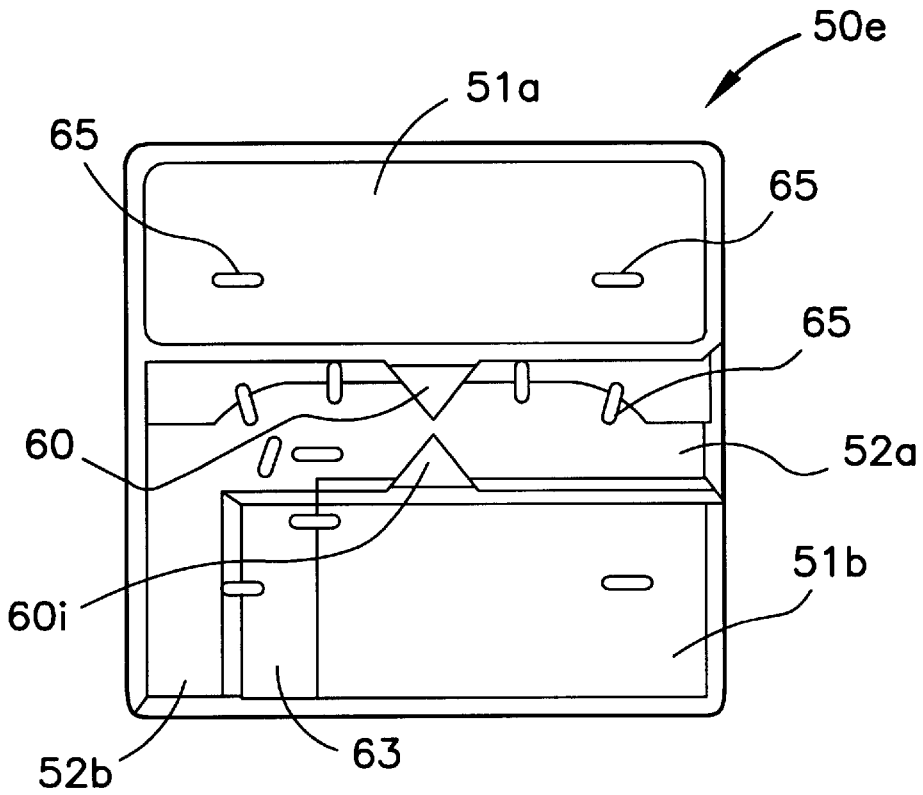
FIG. 16 is a top perspective view of an alternative embodiment of a sealing plate of the present invention.
Figure 17:
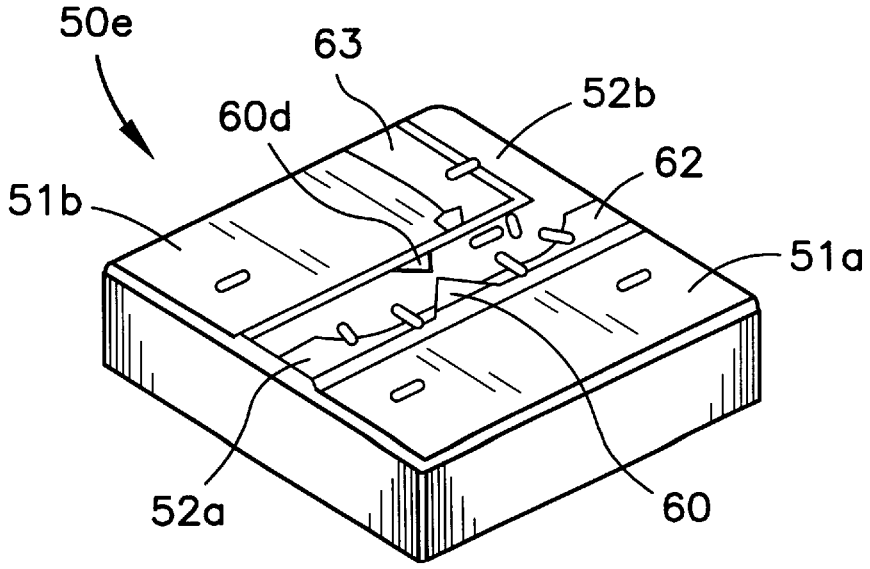
FIG. 17 is a top plan view of the sealing plate of FIG. 16.

FIGS. 16 and 17 represent different views of an alternative embodiment of the sealing plate of the present invention. Similarities between the sealing plate 50 of FIG. 6 and the sealing plate 50*e* of FIGS. 16 and 17 will utilize the same reference designations. The sealing plate 50*e* is primarily directed at providing an elevated bottom on a carton formed from a PURE-PAK® carton blank. The sealing plate 50*e* has the pressing surface 51*a–b* and first elevated portions 52*a–b*. The sealing plate 50*e* also has a plurality of second elevated portions 60 and 60*d* which may both lie on the third horizontal plane. A plurality of channel protrusions 65 are also dispersed throughout the sealing plate 50*e*. The various elevations also have transition edges between different elevations. The second pressing surface 62 extends along the traversal portion 51*a* and is interrupted by the second elevated portion 60.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims:

We claim as our invention:

1. An apparatus for forming elevated portions on a carton bottom, the apparatus comprising:

a mandrel cap having a body with an engagement surface, a first end and a second end opposite the first end, the engagement surface having a first recess traversing the engagement surface from the first end to the second end, the engagement surface having an angled edge extending along a portion of the first end; and a sealing plate for engaging with the mandrel cap, the sealing plate having a pressing surface, a first end and a second end opposite the first end, the pressing surface having a first elevated portion having a traversal section and an edge section continuous and substantially coplanar with one another, the traversal section extending substantially from the first end to the second end, and the edge section extending substantially perpendicular to the traversal section along a portion of the first end, wherein the first elevated portion and the pressing surface are on separate parallel planes.

2. The apparatus according to claim 1 further comprising a second elevated portion disposed on the first elevated portion.

3. The apparatus according to claim 1 further comprising a plurality of second elevated portions, at least one of the plurality of second elevated portions disposed on the first elevated portion.

4. The apparatus according to claim 1 further comprising a transition edge disposed on the edge section of the first elevated portion.

5. The apparatus according to claim 1 further comprising a plurality of transition edges, at least one of the plurality of transition edges disposed on the edge section of the first elevated portion.

6. The apparatus according to claim 2 wherein the sealing plate includes a plurality of transition edges between the second elevated portion and the first elevated portion, and a plurality of transition edges between the first elevated portion and the pressing surface.

7. The apparatus according to claim 1 wherein the pressing surface has a recess area, and wherein the pressing surface lies on a first plane, the first elevated portion lies on a second plane parallel to the first plane, and the recess area of the pressing surface lies on a recess plane, and wherein the first plane is disposed between the second and recess planes.

8. The apparatus according to claim 2 wherein the pressing surface has a recess area, and wherein the pressing surface lies on a first plane, the first elevated portion lies on a second plane parallel to the first plane, the second elevated portion lies on a third plane parallel to the first and second planes, and the recess area of the pressing surface lies on a recess plane, and wherein the first plane is disposed between the second and recess planes.

9. The apparatus according to claim 2 wherein the first elevated portion and a part of the second elevated portion include a panel recess area, wherein the pressing surface lies on a first plane, the first elevated portion lies on a second plane parallel to the first plane, the second elevated portion lies on a third plane parallel to the first and second planes, and the panel recess area of the first elevated portion lies on a recesses plane between the first and second planes.

10. The apparatus according to claim 3 wherein the plurality of second elevated portions comprises a first central section, a second central section opposite the first central section, a first end section disposed near the first end of the sealing plate and a second end section opposite the first end section, wherein the first central section, the second central section, the first end section and the second end section are all coplanar.

11. The apparatus according to claim 1 further comprising a second pressing layer disposes on a part of the first elevated portion and a plurality of second elevated portions disposes on the first elevated portion, wherein the plurality of second elevated portions comprises a first central section and a second central section opposite the first central section.

12. A method of forming a carton having elevated portions on the bottom of the carton, the method comprising:

placing an erected carton blank on a mandrel, the mandrel having a mandrel cap having a body with an engagement surface, a first end and a second end opposite the first end, the engagement surface having a first recess traversing the engagement surface from the first end to the second end, the engagement surface having an angled edge extending along a portion of the first end;

rotating the mandrel with the erected carton thereon to a bottom sealing station;

pressing a sealing plate against the bottom panels of the carton and thus the mandrel cap, the sealing plate comprising a pressing surface, a first end and a second end opposite the first end, the pressing surface having a first elevated portion having a traversal section and an edge section continuous and substantially coplanar with one another, the traversal section extending substantially from the first end to the second end, and the edge section extending substantially perpendicular to the traversal section along a portion of the first end, wherein the first elevated portion and the pressing surface are on separate parallel planes; and releasing the carton with an elevated bottom from the mandrel.

13. The method according to claim 12 further comprising heating a plurality of bottom panels prior to rotating the mandrel to a sealing station.

14. The method according to claim 12 wherein the sealing plate further comprises a second elevated portion disposed on the first elevated portion.

15. The method according to claim 12 wherein the sealing plate further comprises a plurality of second elevated portions, at least one of the plurality of second elevated portions disposed on the first elevated portion.

16. The method according to claim 12 wherein the sealing plate further comprises a transition edge disposed on the edge section of the first elevated portion.

17. The method according to claim 12 wherein the sealing plate further comprises a plurality of transition edges, at least one of the plurality of transition edges disposed on the edge section of the first elevated portion.

18. The method according to claim 14 wherein the pressing surface of the sealing plate has a recess area and wherein the pressing surface lies on a first plane, the first elevated portion lies on a second plane parallel to the first plane, the second elevated portion lies on a third plane parallel to the first and second planes, and the recess area of the pressing surface lies on a recess plane, and wherein the first plane is disposed between the second and recess planes.

19. A packaging machine for fabricating a series of cartons, each carton having an elevated bottom, the packaging machine comprising:

a bottom forming station comprising a mandrel cap having a body with an engagement surface, a first end and a second end opposite the first end, the engagement surface having a first recess traversing the engagement surface from the first end to the second end, the engagement surface having an angled edge extending along a portion of the first end, and a sealing plate for engaging with the mandrel cap, the sealing plate having a pressing surface, a first end and a second end opposite the first end, the pressing surface having a first elevated portion having a traversal section and an edge section continuous and substantially coplanar with one another, the traversal section extending substantially from the first end to the second end, and the edge section extending substantially perpendicular to the traversal section along a portion of the first end, wherein the first elevated portion and the pressing surface are on separate parallel planes;

a conveyor for transporting the cartons from the bottom forming station; and a filling station for filling the cartons with a desired product.

20. The packaging machine according to claim 19 wherein the sealing plate further comprises a second elevated portion disposed on the first elevated portion.

* * * * *